US008172986B2

(12) United States Patent
Bella

(10) Patent No.: US 8,172,986 B2
(45) Date of Patent: May 8, 2012

(54) FABRIC BELT HAVING ENDS OF REDUCED THICKNESS

(75) Inventor: Hartmut Bella, Elchingen (DE)

(73) Assignee: Muehlen Sohn GmbH & Co., Blaustein (DE)

( * ) Notice: Subject to any disclaimer, the term of this patent is extended or adjusted under 35 U.S.C. 154(b) by 639 days.

(21) Appl. No.: 12/232,633

(22) Filed: Sep. 22, 2008

(65) Prior Publication Data

US 2009/0107574 A1 Apr. 30, 2009

(30) Foreign Application Priority Data

Oct. 30, 2007 (EP) ..... 07021155

(51) Int. Cl.
*D21F 7/08* (2006.01)
*D21F 7/10* (2006.01)
*D06H 5/00* (2006.01)

(52) U.S. Cl. ..... 162/358.2; 156/462; 162/904

(58) Field of Classification Search ..... 162/348, 162/358.2, 900, 902–904; 139/383 AA, 383 A, 139/425 A; 34/95; 156/462; 198/84.2; 24/31 R, 24/31 F, 31 H, 31 V, 33 P
See application file for complete search history.

(56) References Cited

U.S. PATENT DOCUMENTS

| | | | | |
|---|---|---|---|---|
| 1,932,203 | A * | 10/1933 | Diamond | 24/33 C |
| 3,546,054 | A * | 12/1970 | Ross | 474/254 |
| 5,785,621 | A * | 7/1998 | Birzele | 474/267 |
| 6,627,045 | B2 * | 9/2003 | Raczkowski et al. | 162/348 |

FOREIGN PATENT DOCUMENTS

| | | |
|---|---|---|
| DE | 195 40 229 | 12/1996 |
| WO | WO 02/086232 | 10/2002 |

* cited by examiner

*Primary Examiner* — Eric Hug
(74) *Attorney, Agent, or Firm* — Walter Ottesen

(57) ABSTRACT

A fabric belt unit for manufacturing corrugated board in a corrugator machine includes a belt (1) joined together at its two ends (2, 3) to form a continuous belt. The fabric belt has an outer paper side (6) as well as an inner driven side (8). The belt ends (2, 3) are reduced thermally in thickness and have a plurality of approximately U-shaped clamps (7) which are connected to each other to form a joint. The U-shaped clamps (7) lie at a distance (a) one next to the other. The distance (u) of the driven side (8) of the belt to the plane (36) of the thickness-reduced belt ends (2, 3) is greater than the distance (v) between the paper side (6) and the plane (46) of the thickness-reduced belt ends (2, 3) in order to obtain a longer service life of the belt.

16 Claims, 2 Drawing Sheets

FABRIC BELT HAVING ENDS OF REDUCED THICKNESS

CROSS REFERENCE TO RELATED APPLICATION

This application claims priority of European patent application no. 07021155.2, filed Oct. 30, 2007, the entire content of which is incorporated herein by reference.

FIELD OF THE INVENTION

The invention relates to a fabric belt for manufacturing corrugated board in a corrugator machine.

BACKGROUND OF THE INVENTION

The connection of a fabric belt to a continuous belt is known from DE 195 40 229 C1. The belt ends are reduced in thickness and a plurality of clamps are pressed in for making a connection. The clamps lie at a spacing one next to the other. The clamps of one belt end lie offset to the clamps of the other belt end. A moveable joint is formed when the clamps of one end are pushed into the clamps of the other end and a connecting rod is inserted which passes in common through all clamps. This moveable joint ensures a disturbance-free run of the belt on the guide rollers, drive rollers or the like.

The fabric belt is subjected to increased wear because of abrasion especially on the driven side. The connection of the belt ends must be so configured that the clamps do not come in contact with the drive rollers. This can lead to a destruction of the connection and therefore to the tearing of the continuous belt.

From WO 02/086232 A1, it is known to coat the thickness-reduced belt ends with a flock material in order to equalize the depression in the belt formed by the thickness reduction. A belt of this kind has proven itself in practice; however, the service life continues to be determined by the wear on the driven side. When the flock material is abraded, the clamps of the connection can wear which leads to a destruction of the belt.

SUMMARY OF THE INVENTION

It is an object of the invention to configure a fabric belt for the manufacture of corrugated board in a corrugator machine in such a manner that the service life of the fabric belt is increased.

The fabric belt unit of the invention is for manufacturing corrugated board. The fabric belt unit includes: a fabric belt defining a longitudinal direction and having first and second end portions joined to form a continuous belt; the fabric belt having an outer paper side facing toward the corrugated board transported thereon and an inner driven side for taking up drive forces applied thereto during operation of the fabric belt unit; a first one of the sides defining a first plane and a second one of the sides defining a second plane; the first and second end portions being thermally reduced in thickness from both of the sides relative to the remainder of the fabric belt; a first plurality of approximately U-shaped clamps being pressed into the first end portion and a second plurality of approximately U-shaped clamps being pressed into the second end portion for mutually connecting the end portions and coacting in the longitudinal direction to transmit force therebetween; the U-shaped clamps of each of the first and second pluralities being spaced at a spacing (a) one next to the other; each one of the U-shaped clamps having first and second legs and each of the legs having free bent-over end sections pressed into the fabric of the end section corresponding to the one U-shaped clamp; the first and second end portions with the respective first and second pluralities of pressed-in clamps each defining a top surface plane at a first distance (u) below the first plane; the first and second end portions with the respective first and second pluralities of pressed-in clamps each defining a bottom surface plane at a second distance (v) above the second plane; and, the first distance (u) being greater than the second distance (v).

According to the basic idea of the invention, the distance of the plane of the thickness-reduced belt end having the pressed-in clamps and facing toward the first belt side to the plane of this first belt side is greater than the distance of the plane of the thickness-reduced end having the pressed-in clamps and facing toward the second, other belt side, to the second, other belt side. The first belt side is the belt side having intense wear on which the pressing of the belt ends is configured stronger than on the second belt side which is subjected to less wear. In this way, more material is made available for wear on the belt side subjected to more wear before the clamps of the connecting location of the belt ends are exposed and likewise abraded. The service life of the continuous belt can be increased in a simple manner because of the greater thickness reduction on the belt side subjected to more wear.

The fabric of the belt on the first belt side, which is subjected to greater wear, is advantageously configured to be looser than the fabric on the second belt side in order to obtain, in a simple manner, a thickness reduction via heated press plates and simultaneously to achieve a greater thickness reduction on the belt side which is more wear intensive. The looser fabric can be more intensively pressed together whereby the greater thickness reduction results on the wear side.

It can also be practical to configure a portion of the fibers of the fabric with a material having a lower melt point on the side of the belt subject to greater wear than the other fibers of the fabric on the same side or the other fibers of the belt itself. Because of the lower melt point, the press plate acting on the belt side, which is subjected to greater wear, can sink into the fabric to a greater extent than on the opposite-lying other belt side. It can be practical to configure the fabric on the first belt side, which is subjected to greater wear, completely of fibers which have a lower melt point than the fibers of the fabric on the other, second belt side.

An advantageous dimension of the distance on the belt side, which is more wear intensive, is achieved when the distance between the plane of the thickness-reduced belt ends and the plane of the belt side, which is subjected to greater wear, is greater by a factor of 1.4 to 4 than the distance of the plane of the thickness-reduced belt ends to the plane of the other belt side subjected to less wear. A value has been shown to be advantageous according to which the distance on the belt side, which is subjected to greater wear, is approximately twice as large as the distance on the side which is subjected to little wear.

If changes in the fabric of the fabric belt, the fabric structure and the fabric fibers used are to be avoided, the thickness reduction can be achieved in that this thickness reduction is carried out on the side, which is subjected to intense wear, at a higher temperature than on the side subjected to little wear.

A practical material for the fibers having a lower melt point is polypropylene. The other fibers, which have a higher melt point, preferably comprise polyester. It can be practical to apply the material having a lower melt point as a coating onto a fiber of material having a higher melt point.

For a fabric belt for manufacturing a corrugated board in a corrugator machine, the first belt side, which is subjected to intense wear, is the driven side and the second belt side, which is subjected to little wear, is the paper side.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
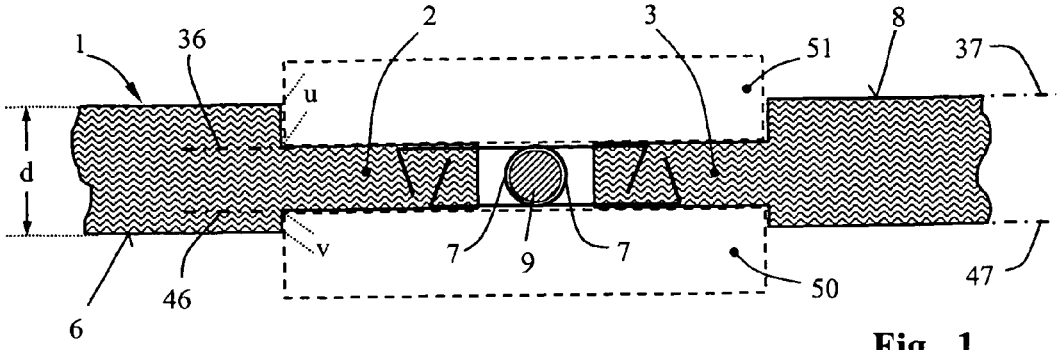
FIG. 1 is a schematic illustration of a section through the opposite-lying ends of a clamped fabric belt having a thickness reduction.
Figure 4:
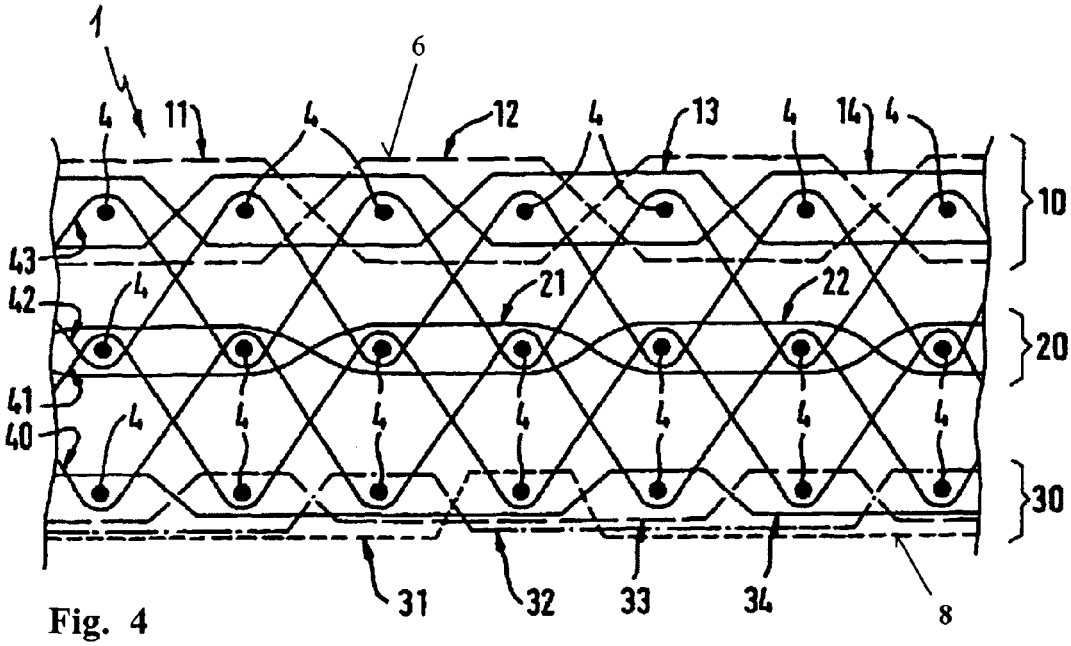
FIG. 4 is a schematic section through the fiber course of a fabric belt.

The belt 1 is shown schematically in FIG. 1 and comprises one or several fabric layers (10, 20, 30) as shown by way of example in the section view of FIG. 4. The belt ends (2, 3) are connected to each other for making a continuous belt as it is used in the manufacture of paper, especially in the manufacture of corrugated board.

In a preferred embodiment and as shown in FIG. 4, the fabric structure of the belt is comprised of an upper fabric layer 10, a middle fabric layer 20, which takes up tension forces, and a lower fabric layer 30. The side of the upper fabric layer 10, which faces away from the middle fabric layer 20 taking up the tension forces, defines the paper side 6 of the fabric belt 1.

Figure 5:
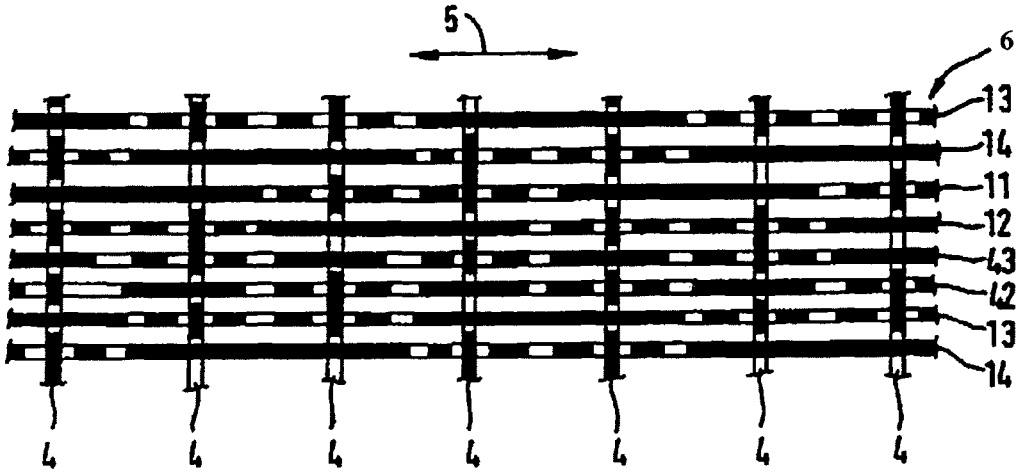
FIG. 5 is a plan view of the fiber course of the paper side of the fabric belt.
Figure 6:
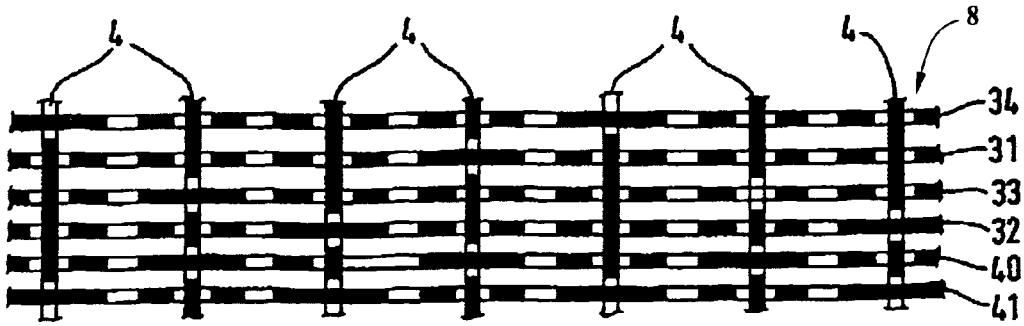
FIG. 6 shows a plan view of the fiber course of the driven side of the fabric belt; and, FIG. 7 shows a section taken through a coated fiber.

In the fabric layers (10, 20, 30), the weft fibers 4 run transversely to the longitudinal direction 5 (FIGS. 5 and 6) of the belt 1.

In the upper fabric layer 10, four warp fibers 11, 12, 13 and 14 are provided and run offset with respect to each other. These warp fibers each run inwardly toward the middle fabric layer 20 as well as outwardly to the paper side 6 over at least two weft fibers 4. The middle fabric layer 20 takes up the tension forces and has two warp fibers 21 and 22 which are offset with respect to each other. These warp fibers run over two weft fibers 4, respectively. The lower fabric layer 30 comprises four warp fibers 31, 32, 33 and 34 which are each offset with respect to the other. These warp fibers each run inwardly to the center fabric layer 20 over only one weft fiber 4 and outwardly over at least three weft fibers 4.

The three fabric layers 10, 20 and 30 are bound to each other by binding fibers 40, 41, 42 and 43. The binding fibers are subdivided into two fiber groups. The binding fibers 42 and 43 form one fiber group and run offset with respect to each other and bind the upper fabric layer 10 to the middle fabric layer 20. The binding fibers 42 and 43 are guided alternately over a weft fiber 4 in the upper fabric layer 10 and a weft fiber 4 in the middle fabric layer 20. In the same way, the fiber group, which comprises the binding fibers 40 and 41, binds the lower fabric layer 30 to the middle fabric layer 20.

The fibers of the fabric belt 1 shown are made of polyester or other suitable support fibers such as cotton. The fabric can also have a portion of more than 30% of fibers of aromatic polyamide. In a preferred embodiment, the fabric belt 1 comprises more than 90% of paraaramide (Kevlar) fibers with a supplementing portion of polyester fibers or other support fibers.

The fabric structure of the belt 1 is deformable by the action of heat because of the material of the fibers used. The belt ends 2 and 3 are reduced in elevation from the start thickness (d) of the fabric structure of the belt 1 in order to connect the belt ends 2 and 3. With a start thickness of approximately 7 mm to 11 mm, preferably approximately 5 mm to 10 mm, the thickness is reduced by a dimension (u, v) of approximately 1 mm to 2 mm, preferably 1.25 mm to 1.75 mm in thickness. For this purpose, it has proven practical to work on the ends (2, 3) of the fabric belt 1 between two pressure plates (50, 51) which are preferably heated. The thickness reduction takes place under increased temperature and pressure.

Clamps 7 are pressed into the thickness-reduced belt ends (2, 3) as shown in FIG. 1. The pressing-in of the clamps 7 takes place under pressure and temperature. It has proven practical to press the clamps in under a higher temperature and a higher pressure than the temperature and pressure applied for the thickness reduction. Advantageously, a temperature of approximately 180° and a pressure of approximately 590 bar are applied in order to press in the clamps. It can be advantageous to carry out the thickness reduction and the pressing in of the clamps simultaneously.

Figure 2:
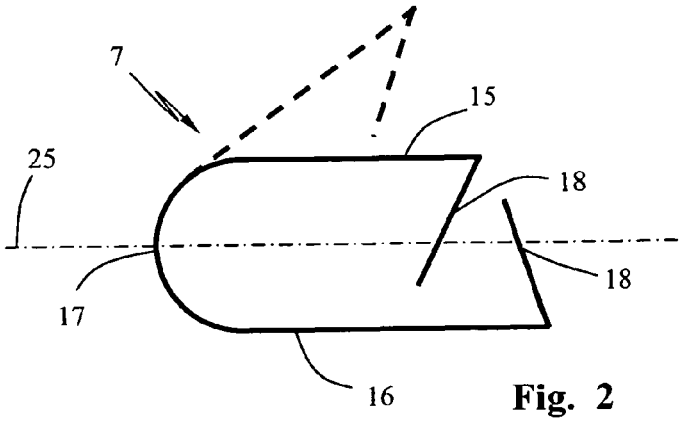
FIG. 2 is a view of a clamp.

The clamps 7 are used to connect the thickness-reduced belt ends (2, 3). The clamps 7 are prebent in correspondence to the illustration in FIG. 2 in advance of their built-in position according to FIG. 1. Each clamp 7 comprises essentially a half-circularly shaped bent head 17 which, with two legs (15, 16) forms the shape of a U approximately symmetrical to a middle plane 25. The one leg 16 is configured longer than the other leg 15. The free end sections 18 of the legs are angled over inwardly in a barb-like manner. The end sections 18 of the closed clamps 7 engage barb-like into the belt ends (2, 3). These end sections 18 are pressed tightly into the thickness-reduced fabric belt ends (2, 3) so that they do not loosen from the belt ends even under high mechanical load in the longitudinal direction of the belt.

Figure 3:
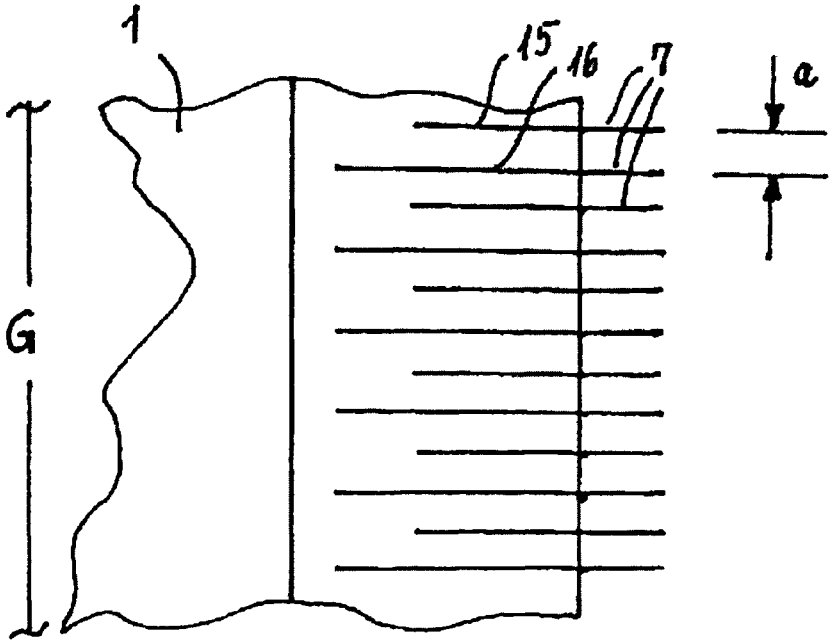
FIG. 3 shows an enlarged plan view of a thickness-reduced belt end having clamps.

As FIG. 3 shows, a plurality of clamps 7 are arranged over the width G of the belt 1 in each belt end. The clamps 7 are at the same spacing (a) one to the other. For achieving a high strength of the connection, a distance (a) of approximately 1.8 mm to approximately 4 mm is selected.

As also shown in FIG. 3, the clamps 7 are arranged in such a manner that mutually adjacent clamps lie rotated by 180° with respect to each other. In this way, once the shorter leg 15 lies on a side and then the longer leg 16 lies on that side. The lengths of the legs 15 and 16 of the clamps 7 lie approximately between 16 mm and 26 mm.

As FIG. 1 shows, the clamps 7 of the one belt end 2 lie in the gaps between the clamps 7 of the other belt end 3. In this way, the belt ends (2, 3) can be brought close to each other so that a connecting rod 9 can be inserted through all clamps 7 of both belt ends (2, 3). This connecting rod 9 together with the clamps 7 forms a moveable joint at the seam location of the continuous belt. The connecting rod has a cylindrical cross section and an approximate diameter of preferably 2 mm to 4 mm.

In order to achieve a leveling of the belt surfaces after introducing the clamping, a flock material can be applied which fills the space between the thickness-reduced ends and the paper side 6 and the thickness-reduced ends and the driven side 8.

To achieve a longer service life of the belt 1, a thickness reduction by a dimension (u) is provided on the driven side 8 of the fabric belt 1 which is significantly greater than the dimension (v) of the thickness reduction on the paper side 6. It is practical to select the distance (u) between the plane 36 of the belt ends (2, 3) facing toward the driven side 8 to the plane 37 of the driven side 8 greater by 40% to 400% than the distance (v) which the plane 46 of the thickness-reduced belt ends (2, 3) has to the plane 47 of the paper side 6 with the plane 46 facing toward the paper side 6. In a special configuration, the distance (u) is approximately twice the distance (v).

The pressure plate 51 on the driven side of the belt is heated up to a higher temperature than the pressure plate 50 on the paper side of the belt in order to achieve a greater thickness reduction on the driven side 8 than on the paper side 6. The applied pressure when moving the pressure plates 50 and 51 together is the same on both belt sides (6, 8) so that more material can be melted and compressed in the same time span on the driven side 8 than on the paper side 6 only because of the higher temperature of the pressure plate 51.

In a further embodiment of the invention, the fabric of the belt 1 is configured to be looser on the driven side 8 than the fabric of the belt 1 on the paper side 6 in order to obtain a greater dimension (u) of thickness reduction at the same temperature of the pressure plates 50 and 51 and the same pressure on the driven side 8. This can be achieved in that, on the driven side, for example, one warp fiber (31, 32, 33, 34) less is processed than on the paper side. Because of the looser fabric on the driven side 8, the pressure plate 51 will, at the same temperature in the same time span, sink deeper into the fabric belt than the pressure plate 50 on the paper side 6 so that a greater dimension (u) of thickness reduction is obtained on the driven side 8.

If the fabric on the paper side 6 is to be configured to have the same thickness as on the driven side 8, a different thickness reduction can be obtained in that a portion of the fibers of the fabric have a lower melt point on the driven side 8 than the other fibers of the fabric on the paper side 6. The lower melt point of some of the fabric fibers, which are processed on the driven side 8, leads likewise to the condition that, for the same temperature of the pressure plates (50, 51), the pressure plate 51 on the driven side 8 sinks deeper into the fabric structure than on the paper side. It can be practical to provide the fibers on the driven side 8 completely of a material which has a lower melt point than the material of the fibers on the paper side 6 of the fabric belt 1.

As a material mix, the fibers on the driven side of the belt can be of polypropylene while the remaining fibers of the fabric belt are of polyester. Polypropylene has a melt point of approximately 150° C.; whereas, polyester has a melt point of approximately 180° C.

Figure 7:
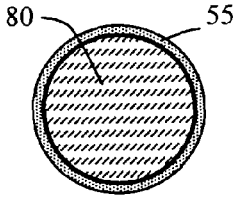

The material having the lower melt point can also be applied as a coating 55 onto the fiber 80 from a material having a higher melt point and can be processed on the driven side 8. FIG. 7 shows such a fiber in section.

It is understood that the foregoing description is that of the preferred embodiments of the invention and that various changes and modifications may be made thereto without departing from the spirit and scope of the invention as defined in the appended claims.

What is claimed is:

1. A fabric belt unit for manufacturing corrugated board, the fabric belt unit comprising:

a fabric belt defining a longitudinal direction and having first and second end portions joined to form a continuous belt;

said fabric belt having an outer paper side facing toward the corrugated board transported thereon and an inner driven side for taking up drive forces applied thereto during operation of said fabric belt unit;

a first one of said sides defining a first plane and a second one of said sides defining a second plane;

said first and second end portions being thermally reduced in thickness from both of said sides relative to the remainder of said fabric belt;

a first plurality of approximately U-shaped clamps being pressed into said first end portion and a second plurality of approximately U-shaped clamps being pressed into said second end portion for mutually connecting said end portions and coacting in said longitudinal direction to transmit force therebetween;

the U-shaped clamps of each of said first and second pluralities being spaced at a spacing (a) one next to the other;

each one of said U-shaped clamps having first and second legs and each of said legs having free bent-over end sections pressed into the fabric of the end section corresponding to said one U-shaped clamp;

said first and second end portions with said respective first and second pluralities of pressed-in clamps each defining a top surface plane at a first distance (u) below said first plane;

said first and second end portions with said respective first and second pluralities of pressed-in clamps each defining a bottom surface plane at a second distance (v) above said second plane;

said first distance (u) being greater than said second distance (v);

the fabric of said fabric belt being configured to be looser on said first side than the fabric on said second side;

the material of a portion of the fibers of the fabric on said first side having a lower melt point than the material of the other fibers on said first side; and, the fabric on said first side comprising fibers which have a lower melt point than the other fibers of the fabric on said second side.

2. The fabric belt unit of claim 1, wherein said distance (u) on said first side is greater by a factor of 1.4 to 4 than said distance (v) on said second side.

3. The fabric belt unit of claim 2, wherein said distance (u) is greater by approximately a factor of 2 than said distance (v).

4. The fabric belt unit of claim 2, wherein the thickness reduction on said first side takes place at a higher temperature than on said second side.

5. The fabric belt unit of claim 4, wherein the material of at least some fibers on said first side is polypropylene.

6. The fabric belt unit of claim 5, wherein the material of the remaining fibers of the fabric of said fabric belt is polyester.

7. The fabric belt unit of claim 6, wherein the material having a lower melt point is applied as a coating onto a fiber of a material having a higher melt point.

8. The fabric belt unit of claim 7, wherein the first side is said inner driven side and the second side is said outer paper side.

9. A fabric belt unit for manufacturing corrugated board, the fabric belt unit comprising:

a fabric belt defining a longitudinal direction and having first and second end portions joined to form a continuous belt;

said fabric belt having an outer paper side facing toward the corrugated board transported thereon and an inner driven side for taking up drive forces applied thereto during operation of said fabric belt unit;

a first one of said sides defining a first plane and a second one of said sides defining a second plane;

said first and second end portions being thermally reduced in thickness from both of said sides relative to the remainder of said fabric belt;

a first plurality of approximately U-shaped clamps being pressed into said first end portion and a second plurality of approximately U-shaped clamps being pressed into said second end portion for mutually connecting said end portions and coacting in said longitudinal direction to transmit force therebetween;

the U-shaped clamps of each of said first and second pluralities being spaced at a spacing (a) one next to the other;

each one of said U-shaped clamps having first and second legs and each of said legs having free bent-over end sections pressed into the fabric of the end section corresponding to said one U-shaped clamp;

said first and second end portions with said respective first and second pluralities of pressed-in clamps each defining a top surface plane at a first distance (u) below said first plane;

said first and second end portions with said respective first and second pluralities of pressed-in clamps each defining a bottom surface plane at a second distance (v) above said second plane;

said first distance (u) being greater than said second distance (v); and, said distance (u) on said first side being greater by a factor of 1.4 to 4 than said distance (v) on said second side.

10. The fabric belt unit of claim 9, wherein said distance (u) is greater by approximately a factor of 2 than said distance (v).

11. The fabric belt unit of claim 9, wherein the thickness reduction on said first side takes place at a higher temperature than on said second side.

12. The fabric belt unit of claim 11, wherein the material of at least some fibers on said first side is polypropylene.

13. The fabric belt unit of claim 12, wherein the material of the remaining fibers of the fabric of said fabric belt is polyester.

14. The fabric belt unit of claim 13, wherein the material having a lower melt point is applied as a coating onto a fiber of a material having a higher melt point.

15. The fabric belt unit of claim 14, wherein the first side is said inner driven side and the second side is said outer paper side.

16. The fabric belt unit of claim 9, wherein the first side is said inner driven side and the second side is said outer paper side.

* * * * *